US005410974A

United States Patent [19]

Henz et al.

[11] Patent Number: 5,410,974

[45] Date of Patent: May 2, 1995

[54] EMBROIDERY MACHINE WITH CENTER DRIVE

[75] Inventors: Jürg Henz, Amriswil; Hans Abegglen, Arbon, both of Switzerland; Manfred Zesch, Fussach, Austria

[73] Assignee: Saurer Sticksysteme AG, Arbon, Switzerland

[21] Appl. No.: 161,606

[22] Filed: Dec. 6, 1993

[30] Foreign Application Priority Data

Dec. 8, 1992 [DE] Germany ..... 42 41 200.5

[51] Int. Cl.[6] ..... D05C 3/04

[52] U.S. Cl. ..... 112/83

[58] Field of Search ..... 112/78, 83, 98, 84, 112/90, 117, 119

[56] References Cited

U.S. PATENT DOCUMENTS

| | | | |
|---|---|---|---|
| 761,028 | 5/1904 | Bourquin et al. | 112/83 |
| 3,680,505 | 8/1972 | Reich | 112/83 |
| 3,991,693 | 11/1976 | Moran et al. | 112/87 |
| 4,051,793 | 10/1977 | Reich | 112/83 |

FOREIGN PATENT DOCUMENTS

| | | | |
|---|---|---|---|
| 193625 | 2/1985 | European Pat. Off. . | |
| 2643291 | 3/1978 | Germany | 112/83 |
| 3128858 | 2/1983 | Germany . | |
| 2923575 | 9/1983 | Germany . | |
| 3243549 | 5/1986 | Germany . | |
| 3502894 | 7/1986 | Germany . | |
| 3006732 | 8/1986 | Germany . | |
| 3516832 | 11/1986 | Germany . | |
| 2927869 | 8/1987 | Germany . | |
| 3923419 | 1/1990 | Germany . | |

*Primary Examiner*—Clifford D. Crowder
*Assistant Examiner*—Ismael Izaguirre
*Attorney, Agent, or Firm*—Keck, Mahin & Cate

[57] ABSTRACT

The invention pertains to an embroidery machine with a plurality of embroidery stations provided with corresponding embroidery tools which are attached to shafts that oscillate during the operation of the machine and extend along the embroidery machine. The shafts are actuated via corresponding drives. To reduce the torsion as well as the torsional oscillation of long shafts which leads to a distortion of the movement of the embroidery tools and to a chronological phase displacement between the front and the rear portion of the machine, the drives for the needles and for the other embroidery tools are arranged approximately in the center of the embroidery machine.

8 Claims, 4 Drawing Sheets

38
5
37
34
6
35
19
40
20
17
15
33
29
16
18

EMBROIDERY MACHINE WITH CENTER DRIVE

FILED OF THE INVENTION

The invention pertains to an embroidery machine in which a large number of individual embroidery stations are arranged horizontally.

BACKGROUND OF THE INVENTION

Two basic arrangements have thus far been introduced for realizing the drive of embroidery tools of industrial embroidery machines.

According to one arrangement, a main motor with a main drive shaft is arranged along and across the embroidery machine. Cam plates for the individual drives of the embroidery tools are fastened on this main drive shaft. The movement is, via roller levers and additional transfer elements, transferred onto several oscillating shafts which extend along the entire machine and, in turn, actuate the linear movement of the corresponding embroidery tools at the numerous embroidery stations. A similar arrangement is described and schematically illustrated in FIG. 1 of DE 3,502,894.

According to a different arrangement, the main drive shaft is arranged along the machine. The corresponding cam plates are fastened on the front and the rear of this rotating main drive shaft. The movements are transferred from these cam plates onto different oscillating shafts which extend along the embroidery machine and, in turn, actuate the different embroidery tools at the numerous embroidery stations. Such an arrangement is illustrated in FIG. 1 of EP 0,193,625.

This particular patent also suggests a new solution in which the cam plates are replaced by highly dynamic electric motors, so that the different oscillating shafts which extend along the embroidery machine are driven by "electronic cam gears" in order to actuate the embroidery tools.

All three solutions have one severe disadvantage: when an industrial embroidery machine has a length of 10–20 m, it becomes very difficult to control the long oscillating shafts in a dynamic fashion at higher rotational speeds. The torsion and the torsional oscillations of these long shafts lead to a distortion of the movement to be performed by the embroidery tools as well as to a chronological phase displacement between the front and rear portion of the machine. This aspect represents one of the factors which limit the rotational speed of industrial embroidery machines if the machines operate with rotational speeds above 200 rpm.

SUMMARY OF THE INVENTION

The invention is based on the objective to remove the technical limitation of the rotational speed and simultaneously attain a less expensive solution.

According to the invention, this objective is attained by the fact that the drives for the needles as well as the other embroidery tools are arranged approximately in the center of the embroidery machine.

Due to the arrangement of the drives for the different oscillating shafts actuating the different embroidery tools in the center of the machine, the oscillating length of the drive shafts is generally cut in half, so that the limiting values of the tolerable dynamic fluctuations only occur at higher rotational speeds. The aforementioned measure also eliminates the main drive shaft which is arranged along or perpendicularly to the machine.

This concentrated central arrangement facilitates a combination of all these drives into one compact actuation group.

It is possible to distribute several such actuation groups along the machine in order to divide the oscillating drive shafts for the different embroidery tools into even shorter sections. These actuation groups are preferably incorporated into modular, premounted structural components which, if assembled in a row during the final mounting process, result in embroidery machines with the corresponding length. These actuation groups may be connected with each other via one collective shaft and driven by one collective motor. However, modern actuation technology makes it possible to equip each actuation group with its own drive motor, and to synchronize the motors with each other very accurately.

The requirements of embroidery technology, the dynamic problems of such large machines, and the relatively high rotational speeds result in quite complex moving sequences of the individual embroidery tools which must be synchronized with each other in the most accurate fashion possible. Cam gears with double cams have been successfully used for such drives. These cam gears may be easily adjusted relative to each other chronologically in order to take into consideration the special requirements of the embroidery process. However, the shape of the cams is constant, which means that the moving sequence of the corresponding embroidery tools is also constant. The use of highly dynamic motors and modern control technology makes it possible to realize such complex movement sequences by means of controlling/regulating the motor. This technology also makes it possible to store different preprogrammed moving sequences, and to retrieve the moving sequences from the machine program on request. However, it was established that even the most modern motor and control technology reaches its limits at extreme accelerations/decelerations. Depending on the technological possibilities and requirements of the embroidery process, an optimal solution may be attained by the fact that some of the embroidery tools are driven via cam gears, while other embroidery tools are driven via highly dynamic regulated motors.

The moving sequences of all the embroidery tools must be accurately synchronized. If the main actuation group is arranged in the center of the machine, the problem of connecting/synchronizing the embroidery tools at the front side and the rear side of the material to be embroidered arises. A mechanical connection for the conventional design of industrial embroidery machines with a center trough for the tenter frame is comparatively demanding and difficult. One drive motor on the actuation group for the embroidery tools in front of the tenter frame and a second drive motor on the actuation group behind the tenter frame are electrically synchronized in a very accurate fashion, whereby the possibility of exactly defined, small chronological displacements between the movements of the embroidery tools in front of the tenter frame and behind the tenter frame is provided in the control mechanism.

A different new design makes it possible to eliminate the center trough for the tenter frame.

This design facilitates a direct mechanical connection between the actuation groups in front of the tenter frame and behind the tenter frame. There are two basic variations to attain this objective, namely a direct mechanical connection via corresponding drive shafts and similar elements, or an electronic coupling may be provided according to a different variation.

This solution makes it possible to use only one main drive motor in the center of the machine, and the exact chronological synchronization of the moving sequences is ensured without additional effort.

BRIEF DESCRIPTION OF THE FIGURES

The invention is described below, in detail, with the aid of the figures. The figures and their description disclose additional characteristics and advantages of the invention, as follows.

DETAILED DESCRIPTION OF THE PREFERRED EMBODIMENT

Figure 1:
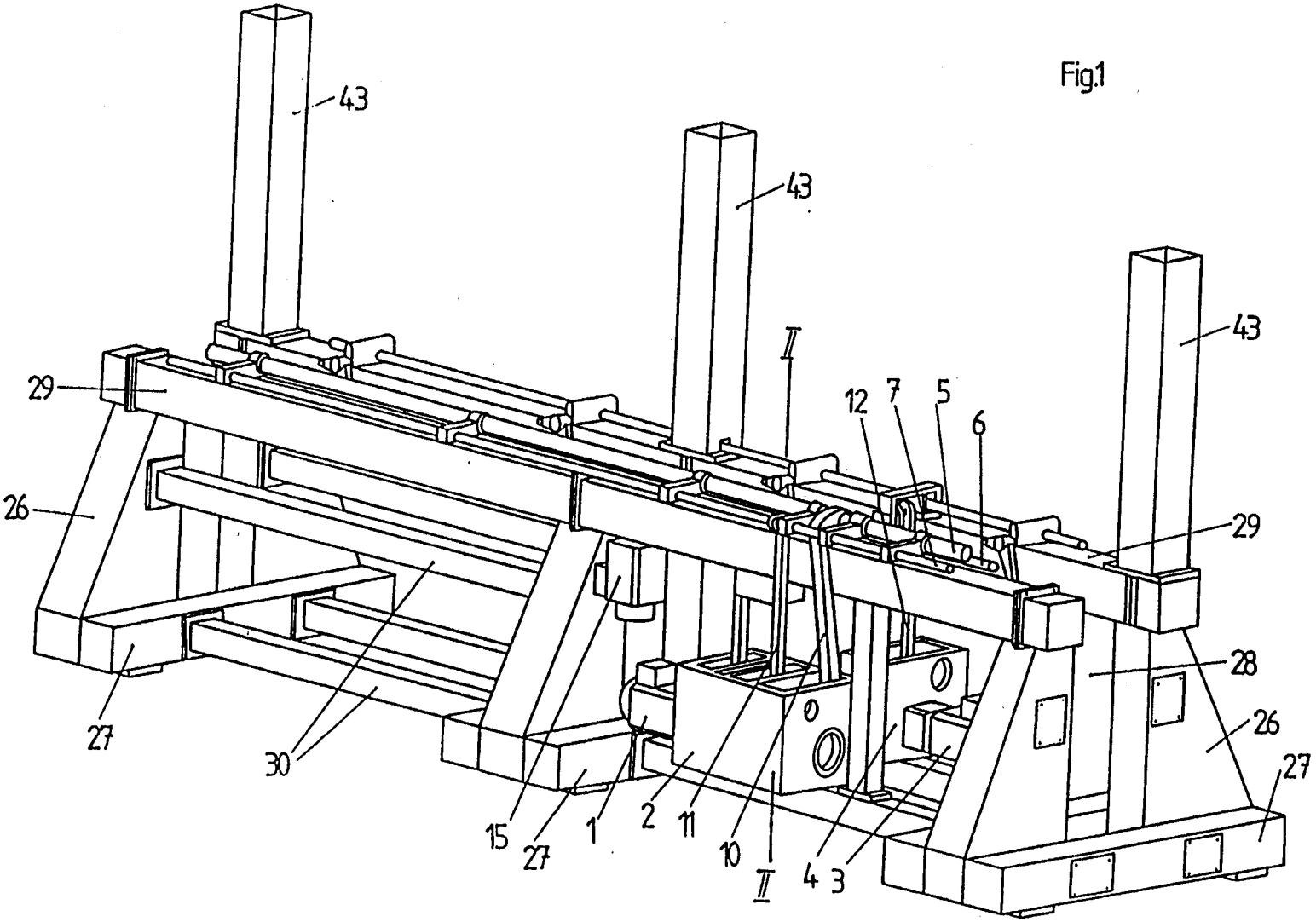
FIG. 1 is a perspective view of a central assembly module for an embroidery machine with a center drive.

According to the invention, a frame of an embroidery machine is of U-shaped construction and includes lower, transversely extending supports 27 arranged between lateral posts 26 which define a channel 28 that is open on a front side therebetween. An approximately U-shaped frame is formed which is reinforced by supports 29 extending in a longitudinal direction.

Additional longitudinal supports 30 are arranged below supports 29. The embroidery tools are arranged on the supports 29. This particular design provides the advantage that additional U-shaped frames may be connected to the front side of the frame.

A main motor 1 is arranged centrally on the front side of the frame, and the motor drives an actuation group 2 which is also situated on the front side of the frame.

An additional actuation group 4 which is driven by the main motor 3 is arranged on the rear side of the frame.

The two actuation groups 2, 4 act upon assigned longitudinal shafts 5, 6, 7, whereby the corresponding embroidery tools are actuated via connecting rods 10, 11, 12.

Connecting rod 10 drives longitudinal shaft 5 for actuation of the embroidery needle, while connecting rod 11 drives longitudinal shaft 7 for actuation of the thread guide.

Actuation group 4 arranged on the rear side drives the oscillating longitudinal rod 9 for the actuation of the shuttle via the connecting rod 12.

FIG. 1 shows drives 1, 3 arranged in the center of the frame, and thus the aforementioned elements are also actuated centrally. The connecting rods 10, 11, 12 act upon corresponding levers which are connected with the previously described longitudinal shafts such that they rotate together. This is illustrated in FIG. 2.

Figure 2:
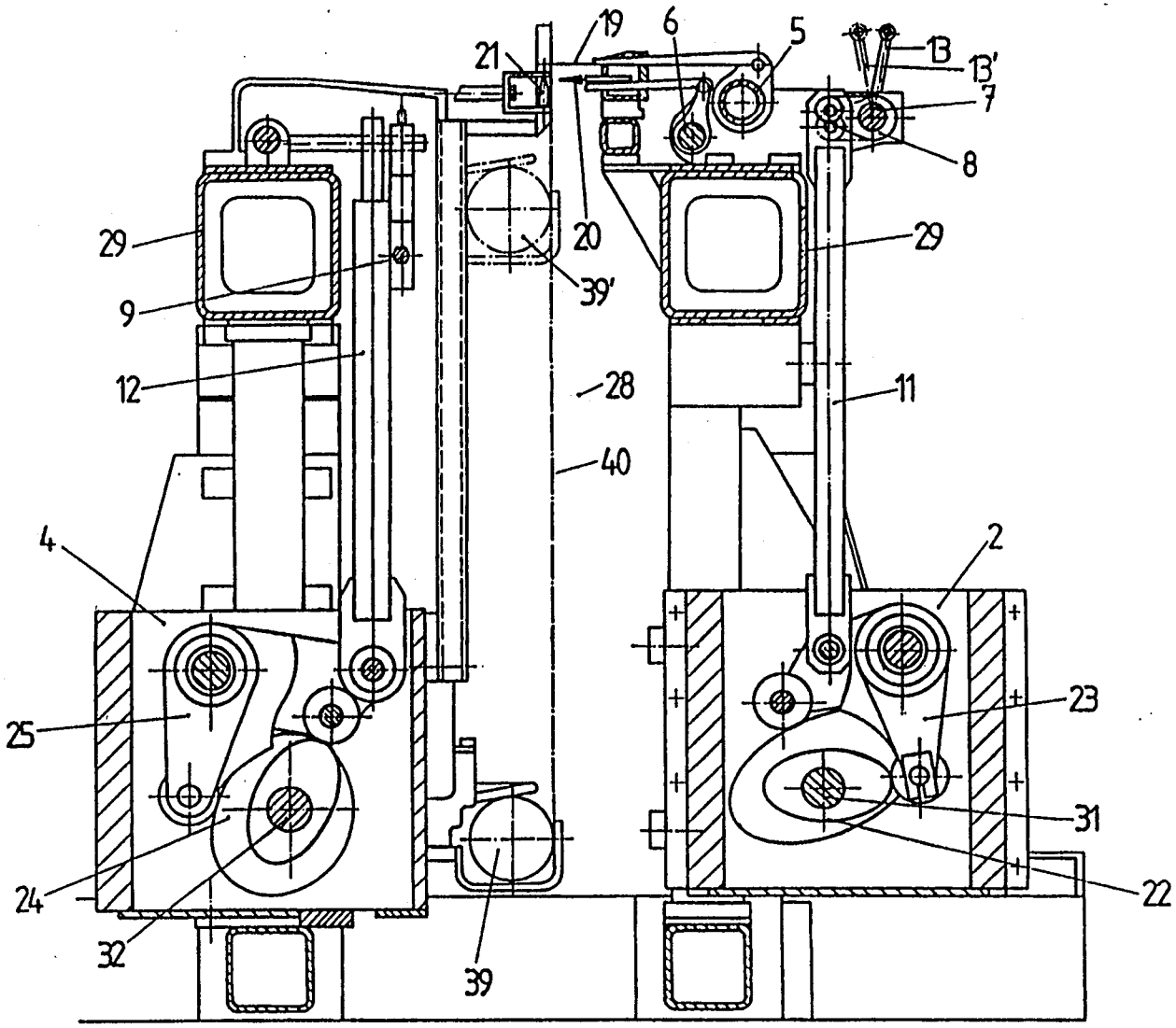
FIG. 2 is a cross-sectional view through a central assembly module taken on line II—II of FIG. 1.

FIG. 2 additionally shows that connecting rod 11 acts upon lever 8 which is illustrated in two different positions. Depending on the position of lever 8, the thread guide 13 accordingly assumes two different positions 13, 13'.

Longitudinal shaft 6 is connected with drill 20 via an additional lever, while longitudinal shaft 5 is coupled with needles 19.

These two tools interact with an opposing shuttle 21. The actuation of the shuttle is performed via connecting rod 12 acting upon oscillating longitudinal rod 9 which in turn actuates shuttle 21 such that it performs a vertical oscillating movement.

The oscillating movements of the different connecting rods 10, 11, 12 are produced by correspondingly rotating cams in the actuation groups 2, 4.

Gear output shaft 31 is, for example, connected with a cam plate 22 such that they rotate together, whereby an assigned roller lever braces itself on the cam plate, and a double roller lever 23 is provided for the actuation of the thread guide.

Actuation group 4 on the rear side of the frame has an identical gear output shaft 32 which is coupled with an assigned cam plate 24 for actuation of the shuttle such that they rotate together. Also, double roller lever 25 is coupled with connecting rod 12.

Material shafts 39 are arranged vertically on top of each other in the area of channel 28, whereby the material shafts 39 move in the vertical as well as horizontal direction.

FIG. 1 also shows that not only the actuation for the embroidery tools is provided with one or more centrally arranged motors, but that the drill also has its own assigned motor 15 which is also arranged approximately in the center of the frame. This measure also attains the characteristics which are essential for the invention, namely a center drive for shafts which extend over the frame in the longitudinal direction and which are no longer exposed to excessive torsional oscillations.

Figure 3:
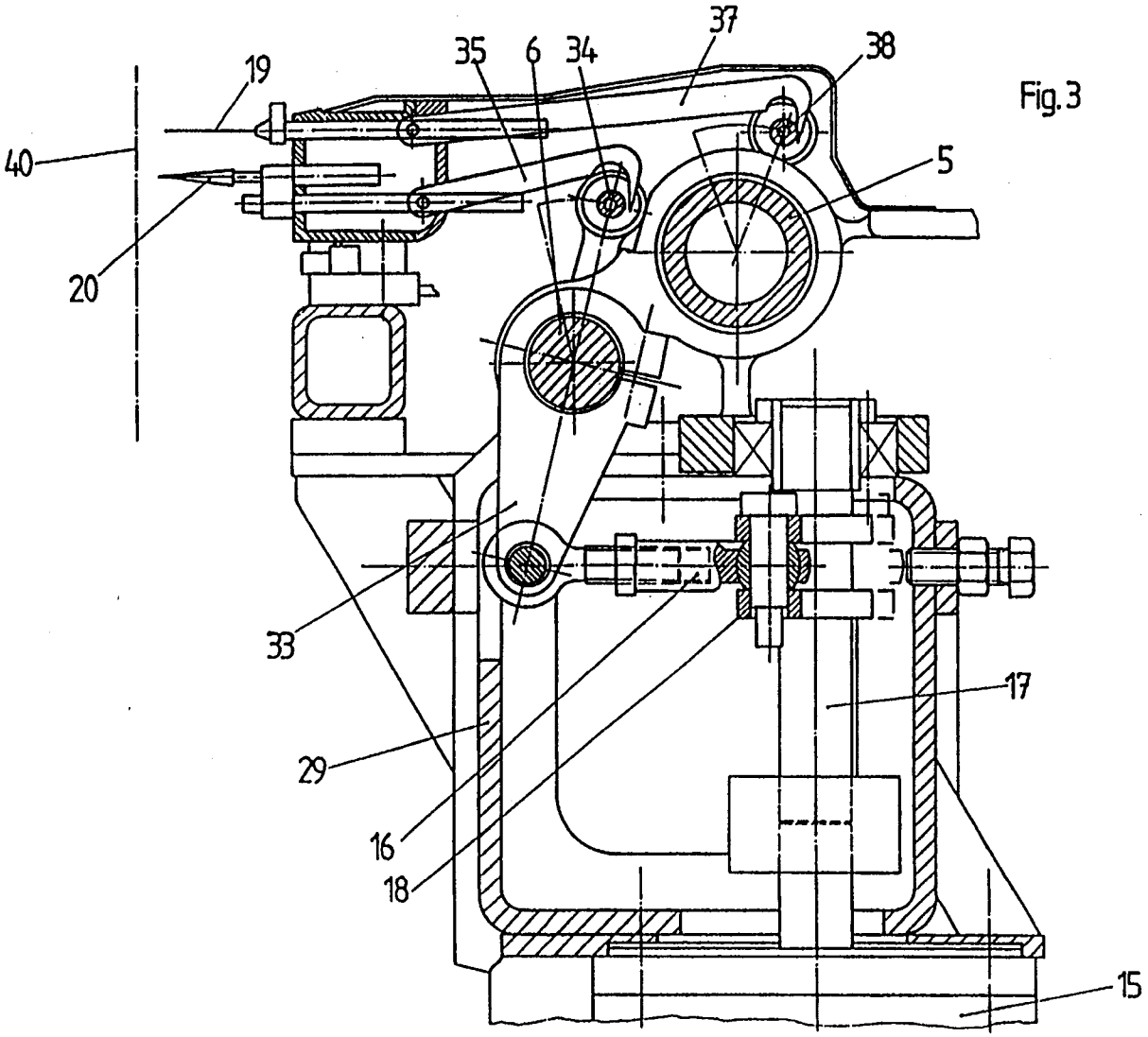
FIG. 3 is a cross-sectional view through a separate embroidery tool drive with a separate motor for actuating the drill.

FIG. 3 shows that the actuation of the drill 20 is flanged onto the motor 15.

The movement of the extended drive shaft 17 of the motor 15 is transferred, via a lever mechanism 18 that is coupled with a connecting rod 16 engaging on a lever 33 which is in turn connected with the oscillating longitudinal shaft 6, such that they rotate together. Additional levers which actuate a longitudinal tube 34 around the rotational axis of the longitudinal shaft 6 in an oscillating manner are connected with the longitudinal shaft 6 such that they rotate together. A catch 35 engages with longitudinal tube 34, and drill 20 is either advanced in a direction toward the embroidery base 40 and penetrates the same or is retracted depending on the position of the catch. The needles 19, with their own separate drives, are arranged above the drill 20, whereby a catch 37 is connected with an identical longitudinal tube 38.

One important aspect in the variations according to FIGS. 1 and 2 is the fact that the main motor 1 on the front side and the main motor 3 on the rear side are electronically coupled with each other. This provides the important advantage that the aforementioned cam plates may be adjusted relative to each other, electronically, without requiring mechanical adjusting elements.

This particular example pertains to an electronic gear, which means that the rotational speed and the phase position of the two main motors 1, 3 is controlled electronically, with mutual feedback and a synchronization that may be changed selectively.

Figure 4:
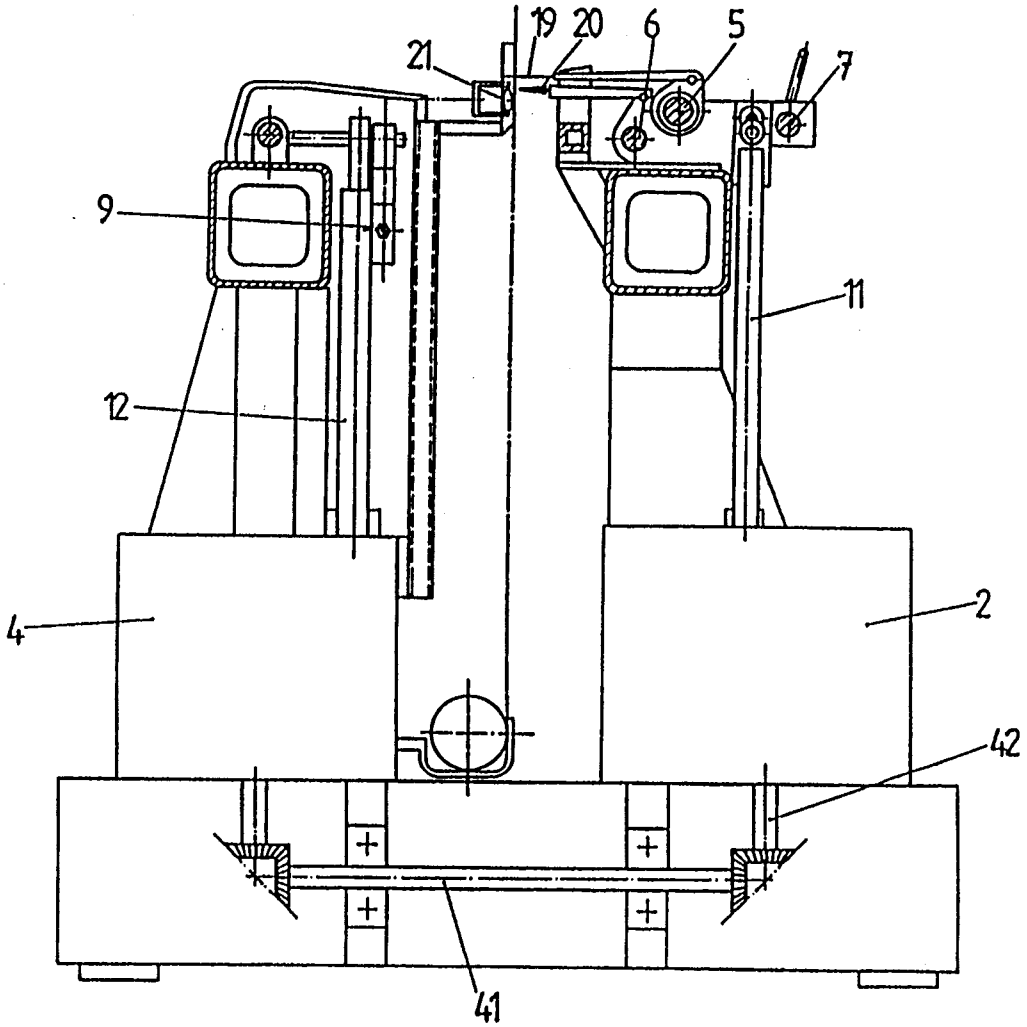
FIG. 4 is a front view, partly in cross-section, through a frame according to FIG. 1 including illustration of an additional mechanical connection for the drives on the front side and rear side of the frame.

FIG. 4 shows a mechanical coupling by means of a mechanical connecting shaft 41 as an alternative to the previously described electronic coupling between the motors 1, 3 whereby only the main motor 1 is provided on the front side of the frame which drives the actuation group 2 on the front side via a corresponding drive shaft that is not shown in detail. The mechanical connecting shaft 42 which drives the actuation group 4 on the rear side via a spur gear and an assigned output shaft is driven via an output shaft 41 and a corresponding additional spur gear.

This particular variation makes it possible to couple individual embroidery tool drives and/or several embroidery tool drives which are combined into a group with an electric drive motor via switchable couplings such that the embroidery tool drives may be selectively switched on or off.

The design of the frame also indicates that vertical supports 43 are arranged within the area of the supports 29 which extend in the longitudinal direction, whereby the supports are also designated as creel towers on which the tenter frame with the material shaft is arranged and guided such that they may be moved in the longitudinal direction.

It is important that all the shafts are, as described above, extendable on the front side so that an additional assembly module may be connected to the front side of the assembly module according to FIG. 1. The additional assembly module is driven via the actuation unit 2, 4 of the assembly module illustrated in FIG. 1.

This measure facilitates higher rotational speeds and a substantially higher output may be obtained in comparison to an arrangement in which the entire actuation is solely arranged on the front side.

One additional essential characteristic is that the abovementioned drive motors are controlled electronically, so that the necessity for providing different mechanical adjusting elements is eliminated as the control of these motors 1, 3 is performed electronically. Thus, the mechanical function of the machine is substantially simplified and is designed in a much more inexpensive manner.

The drive also becomes quieter and oscillates less due to the direct extent of the forces.

The actuation unit may be designed in an easily exchangeable manner due to the compact construction and the modular actuation boxes. This means that embroidery machines with different output may be combined simply in a modular manner.

While the invention has been described above with respect to certain embodiments thereof, it will be appreciated by one skilled in the art that variations and modifications may be made without departing from the spirit or scope of the invention.

What is claimed is:

1. An embroidery machine comprising a plurality of embroidery stations, each embroidery station being provided with embroidery tools, wherein said tools comprise a needle, a borer and a thread guide on one side of material being embroidered and a shuttle on an opposite side of the material being embroidered, said plurality of embroidery stations being arranged horizontally next to each other, said needles, borers, thread guides and shuttles of each embroidery station being driven by shafts corresponding to each of said tools, said shafts extending horizontally between all said embroidery stations, wherein each of said shafts is driven by its own drive unit wherein said drive units are arranged substantially in a center portion of the embroidery machine, along a length thereof.

2. An embroidery machine according to claim 1, wherein at least two of the drive units are combined into one actuation group (2, 4), and a plurality of said actuation groups are driven collectively via a separate electric motor (1).

3. An embroidery machine according to claim 2, wherein at least two of said plurality of actuation groups (2, 4) are arranged next to each other over a length of the machine.

4. An embroidery machine according to claim 2, wherein the drive units are connected with the separate electric motor (1) via switchable couplings whereby the drive units are selectively switched on or off.

5. An embroidery machine according to claim 1, wherein the drive units of the embroidery tools (13, 19, 20, 21) are constructed as cam gears (22, 23, 24, 25).

6. An embroidery machine according to claim 1, wherein the drive units of the embroidery tools (13, 19, 20, 21) are constructed as dynamic motors.

7. An embroidery machine according to claim 1 wherein each said drive unit for the embroidery tools is a member selected from the group consisting of cam gears and dynamic motors.

8. An embroidery machine according to claim 1, wherein one actuation group (2) is arranged on a front side of the embroidery machine, and drive units for the embroidery tools (21) arranged on a rear side of the embroidery machine are mechanically connected with the actuation group (2) such that they are driven via the same motor (1).

* * * * *